United States Patent [19]

Pelfrey

[11] 4,065,861

[45] Jan. 3, 1978

[54] FOOTBALL PUNTING SHOE

[76] Inventor: Raymond H. Pelfrey, 1595 Howard Drive, Sparks, Nev. 89431

[21] Appl. No.: 709,966

[22] Filed: July 30, 1976

[51] Int. Cl.[2] ..... A43B 5/00

[52] U.S. Cl. ..... 36/133

[58] Field of Search ..... 36/133, 128

[56] References Cited

U.S. PATENT DOCUMENTS

| | | | |
|---|---|---|---|
| 2,796,684 | 6/1957 | Montgomery | 36/133 |
| 3,525,165 | 8/1970 | Randall | 36/133 |
| 3,650,051 | 3/1972 | Sass | 36/133 |

*Primary Examiner*—Patrick D. Lawson

*Attorney, Agent, or Firm*—Naylor, Neal & Vilkema

[57] ABSTRACT

A pair of impactor elements are fixedly attached to a football shoe along the side and even with the top and sides of the arch of the foot. These impactors are provided with planar ball impacting surfaces which materially increase the area of contact between the shoe and the football. These impactor elements increase punting consistency, ball total flight time and distances and decrease the slicing of the football to one side during punting when the ball is dropped to the right of the centerline of the arch.

7 Claims, 3 Drawing Figures

FOOTBALL PUNTING SHOE

SUMMARY OF THE INVENTION

Various forms of football kicking aids have been built into football shoes in the past. They fall into one or the other to two classes. One, exemplified by the shoes shown in U.S. Pat. Nos. 1,726,198, 2,107,667, 2,782,531 and 3,851,410, relates to attachment devices intended to aid in field goal kicking, and the other, exemplified by the shoes shown in U.S. Pat. Nos. 1,677,370, 2,661,547, 3,348,842 and 3,525,165, as intended to aid in one way or another in football punting. The present invention falls in the latter class but employs a different means to obtain greater distance and accuracy in punting. It also differs in that it places no additions on the top of the actual arch impact surface, eliminating arch injury due to ball impact force.

The essential object of the invention is to provide a football shoe with a pair of ball impactor elements having planar upper surfaces which extend laterally for predetermined distances away from the longitudinal highline or centerline of the arch of the foot.

A further object of the invention is to so constuct such impactor elements into the shoe and to enclose and protect the same that there will be no relative movement between the impactor elements and the foot or shoe during the punting operation.

Other objects and advantages of the invention will be apparent from the following description taken in conjunction with the drawing forming part of this specification, and in which.

DESCRIPTION OF THE INVENTION

Figure 1:
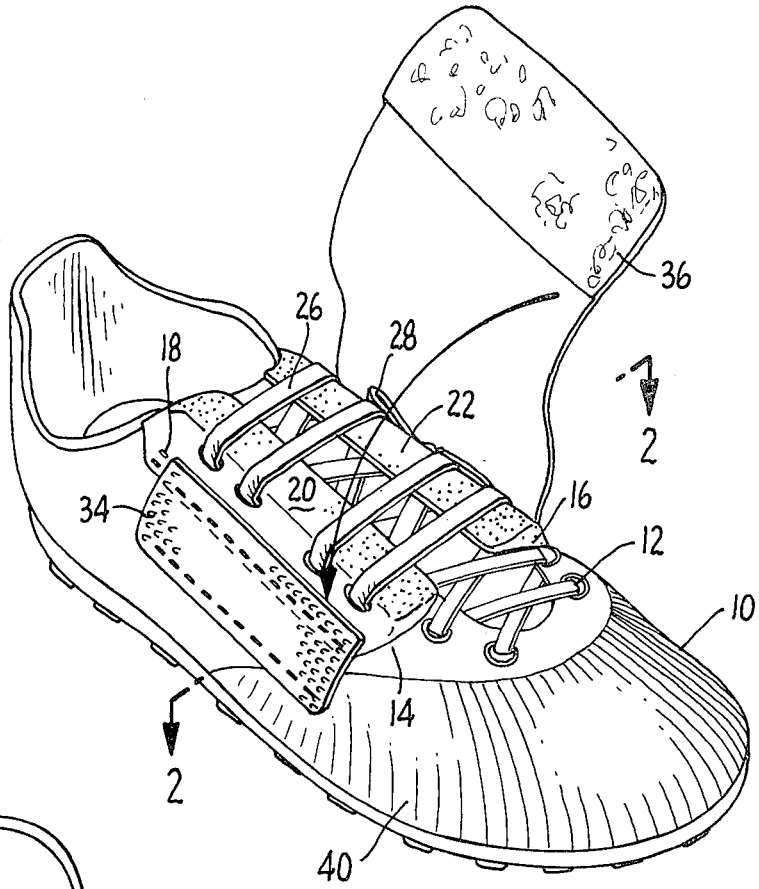
FIG. 1 is a view in perspective of a football punting shoe embodying the invention.
Figure 2:
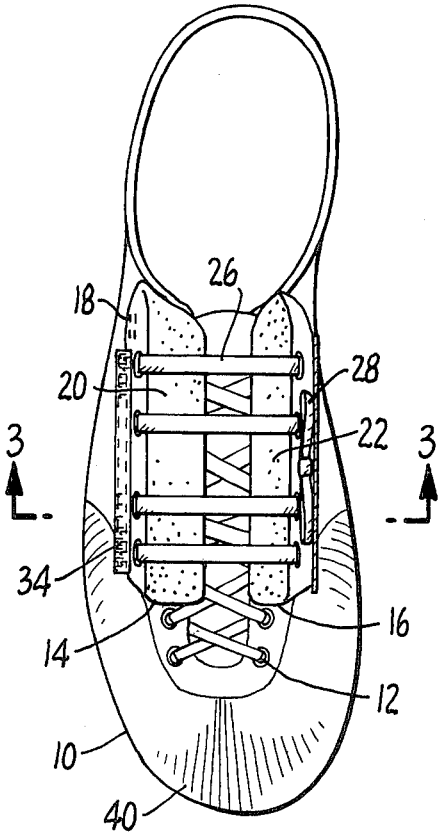
FIG. 2 is a view taken along lines 2—2 of FIG. 1.

The shoe 10 is provided with the usual laces 12.

A pair of impactor elements 14 and 16, which may preferably be formed of layers of shoe sole leather or the like, are attached to the shoe as by one or more rows of stitching 18. The underside surfaces of elements 14 and 16 are in full complemental contact with the shoe surfaces disposed therebeneath and have their upper surfaces 20 and 22 residing in the same plane at the level of the arch highline 24.

The impactor elements are provided with their own separate lacing system comprising lace holes formed therein and lace 26, the tie-off bow 28 of which is located at one side of element 16 and out of the impactor element area for contact with the football. The upper surfaces 20 and 22 of the impactor elements are preferably provided with shallow lace-receiving grooves so that there will be no protuberances along the surfaces 20 and 22.

The impact or elements are provided with an enclosing sheath or cover 30 which is attached to the shoe, as by stitching, along one edge portion 32 thereof. Velcro fastening means 34 attached to the shoe and 36 attached to the underside of the free end of the cover 30 serve to removably secure the cover 30 in a tautly wrapped overlying condition to the impactor elements 14 and 16. The connection between the elements 14 and 16 and the shoe, the lacing connection between the elements 14 and 16, and the taut overwrapping of the elements 14 and 16 furnished by the cover 30 and the Velcro-type fastening means, taken all together serve to very firmly and fixedly relate the impactor elements 14, 16 to the shoe, preventing any relative movement between the shoe and the impactor elements during the kicking operation.

During a proper punting operation, the toes are pointed and flexed downward, exposing the upper arch area, very much like the shape of the upper arch of the foot during the toe-dancing. The arch impact area of the foot of the average punter is about $2\frac{1}{2}$ inches wide and $3\frac{1}{2}$ inches long, for a total of 8.75 square inches. The impactor elements 14 and 16 are preferably about 4 inches long. Elements 16, the inside element for a right-footed punter, has an upper surface 22 of approximately $\frac{1}{2}$ inch in width, while the upper surface 20 of the outside impactor elements is approximately $\frac{3}{4}$ inch wide. Slicing of the ball to the right by a right-footed punter occurs due to the ball hitting the foot to the right of the arch highline or centerline designated generally at 24, and the increased width of the outside impactor element 14 tends to prevent such slicing.

Figure 3:
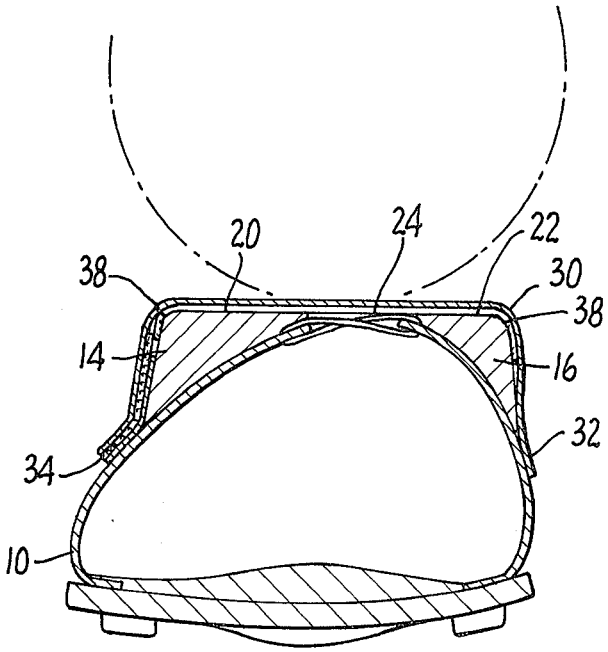
FIG. 3 is a view taken along lines 3—3 of FIG. 2.

The outer edges 38 of the elements 14 and 16 are preferably rounded as shown in FIG. 3. The forward ends of said elements are also preferably rounded.

The upper portion 40 of the shoe forward of the impactor elements 14 and 16 is preferably made out of two-way stretch material in order to make it as easy as possible for the punter to depress the toes on his kicking foot, i.e. to get the foot in the proper arched kicking condition.

What is claimed is:

1. A football punting shoe comprising a shoe having an instep portion characterized by the presence therealong of a longitudinal foot instep highline when a foot disposed therein is arched to a ball-impacting punting position, a pair of ball-impacting elements attached to said instep portion, one at each side of said highline, said elements having aligned planar upper ball-impacting surfaces extending laterally from said instep portion and disposed at the level of said highline in tangential, non-overlying relation to said highline.

2. A football punting shoe comprising a shoe having an instep portion, characterized by the presence therealong of a longitudinal foot instep highline when a foot disposed therein is arched to a ball-impacting punting position, and ball impactor means attached to said instep portion, said ball impactor means having a planar ball impacting surface extending laterally outwardly from the outside side of said instep portion and disposed at the level of said highline in tangential, non-overlying relation to said highline.

3. A football punting shoe comprising a shoe having an instep portion and ball impactor means attached to said instep portion, said ball impactor means having a planar ball impacting surface extending laterally to each side of said instep portion, the impacting surface portion of said impactor means which is directed toward the outside of said instep portion having a greater transverse width dimension than the impacting surface portion of said impactor means which is directed toward the inside of said instep portion, the longitudival center line of said impactor means providing an impact sight line for a punter that is offset towards the outside of said instep portion.

4. A football punting shoe comprising a shoe having an instep portion characterized by the presence therealong of a longitudinal highline when a foot disposed therein is arched to a ball-impacting punting position, a pair of ball-impacting elements attached to said instep portion, one at each side of said highline, said elements having aligned planar upper ball-impacting surfaces extending laterally from said instep portion and disposed at the level of said highline in tangential, non-overlying relation to said highline, said elements being interconnectable by lacing means adapted to be tied off outside of the ball-impacting area of said elements, said planar surfaces of said elements being recessed to accommodate said lacing means substantially flush with said surfaces.

5. The football punting shoe of claim 4, including a removable flexible cover for said elements to enclose and protect them and to positionally maintain them under lateral compression, said cover having one end portion secured to said shoe below one of said elements and having its other end portion removably securable to said shoe below the other of said elements.

6. The football punting shoe of claim 5, including openable and closable complemental fastening means carried by said shoe and by said other end portion of said cover.

7. A football punting shoe comprising a shoe having an instep portion characterized by the presence therealong of a longitudinal highline when a foot disposed therein is arched to a ball-impacting punting position, a pair of ball-impacting elements attached to said instep portion, one at each side of said highline, said elements having aligned planar upper ball-impacting surfaces extending laterally from said instep portion and disposed at the level of said highline in tangential, non-overlying relation to said highline, said shoe having the forward portion of its upper formed of two-way stretch material to facilitate downward flexing and pointing of the punter's toes and the consequent exposing and forming of the upper arch area for the punting of the ball, said ball-impacting elements serving as lateral extensions of said upper arch area.

* * * * *